US006078676A

United States Patent [19]

Takenaka

[11] Patent Number: 6,078,676

[45] Date of Patent: Jun. 20, 2000

[54] SPEAKER SYSTEM WITH A THREE-DIMENSIONAL SPIRAL SOUND PASSAGE

[76] Inventor: Masaaki Takenaka, 1-13-9, Higashinakashinjuku, Kashiwa-shi, Chiba-ken, Japan

[21] Appl. No.: 09/246,642

[22] Filed: Feb. 8, 1999

[30] Foreign Application Priority Data

Feb. 13, 1998 [JP] Japan ..... 10-071177

[51] Int. Cl.[7] ..... H04R 25/00

[52] U.S. Cl. ..... 381/338; 381/341; 381/350; 181/145; 181/153

[58] Field of Search ..... 381/338, 339, 381/345, 346, 347, 350, 340, 341, 342, 160; 181/156, 145, 152, 153, 196, 199

[56] References Cited

U.S. PATENT DOCUMENTS

| | | | |
|---|---|---|---|
| 2,858,377 | 10/1958 | Levy | 381/341 |
| 3,730,291 | 5/1973 | Goeckel | 181/31 B |
| 3,923,124 | 12/1975 | Hancock | 181/156 |
| 4,317,009 | 2/1982 | Shintaku | 381/341 |
| 4,550,229 | 10/1985 | Hwang | 381/340 |
| 4,655,315 | 4/1987 | Saville | 181/153 |
| 5,187,333 | 2/1993 | Adair | 181/152 |
| 5,824,969 | 10/1998 | Takenaka | 181/156 |

FOREIGN PATENT DOCUMENTS

| | | | |
|---|---|---|---|
| 0615408 | 1/1927 | France | 381/160 |
| 0742889 | 1/1956 | United Kingdom | 381/160 |

*Primary Examiner*—Huyen Le
*Attorney, Agent, or Firm*—Ladas & Parry

[57] ABSTRACT

A compact speaker system is capable of reproducing a heavy bass sound with a superior transition characteristic. A sound radiated from a speaker unit passes through a three-dimensional spiral sound passage formed by a coaxial dual-tube structure provided in front of the speaker unit. In the coaxial dual-tube structure, a spiral partition plate is provided to bridge a gap between an outer tube and an inner tube so as to form the spiral sound passage.

8 Claims, 6 Drawing Sheets

SPEAKER SYSTEM WITH A THREE-DIMENSIONAL SPIRAL SOUND PASSAGE

BACKGROUND OF THE INVENTION

1. Field of the Invention

The present invention relates to speaker systems and, more particularly, to a cabinet construction for a front-loaded-horn type speaker system.

2. Description of the Related Art

A front-loaded-horn type speaker system (hereinafter referred to as FLH) is known as one of conventional techniques to boost a low-frequency range of a speaker system. The FLH is a speaker system provided with a horn in front of a speaker unit. The FLH has a feature in that a sound pressure at a low-frequency range can be increased since a sufficiently large load can be accepted at the low-frequency range. Additionally, the FLH is capable of reproducing a bright bass sound with a superior transition characteristic.

However, the FLH has the following drawbacks.

(1) A speaker system becomes extremely large when a cutoff frequency indicating a bass limit is lowered so as to extend an overall sound range, which is not practical for home use.

(2) In order to reduce the size of a horn, a folded horn having a folded middle portion has been developed. However, such a folded horn has a complex construction and is not suitable for mass production, and, thus, a manufacturing cost must be increased.

(3) Since the folded horn is formed by connecting straight sound passages, deterioration of sound quality can not be prevented due to undesired resonance in a straight portion or disturbance of air current at a folded portion.

As mentioned above, although the conventional FLH has superior features, there are many drawbacks and, thus, the FLH has not become popular.

The present inventor suggested in U.S. Pat. No. 5,824,969 an improved speaker system which is related to a back-loaded-horn type speaker system (hereinafter referred to as BLH). This speaker system is constructed so a sound radiated from a back of a speaker unit exits outside after passing through a three-dimensional spiral sound passage formed by a coaxial dual-tube structure and a spiral partition plate provided in a gap formed within the coaxial dual-tube. Thus-constructed improved BLH can be compact and creates a high-fidelity sound. However, this system is not capable of creating a heavy bass sound since a load cannot be applied to a diaphragm at a frequency below 30 Hz.

SUMMARY OF THE INVENTION

It is a general object of the present invention to provide an improved and useful speaker system in which the above-mentioned problems are eliminated.

A more specific object of the present invention is to provide a compact speaker system which is capable of reproducing a heavy bass sound with a superior transition characteristic.

Another object of the present invention is to provide a compact speaker system having less deterioration in sound quality.

A further object of the present invention is to provide a compact speaker system having a construction suitable for mass production.

In order to achieve the above-mentioned objects, there is provided according to the present invention a speaker system comprising:

a speaker unit;

an empty chamber provided in a back of the speaker unit;

a coaxial dual-tube structure provided in front of the speaker unit, the coaxial dual-tube structure comprising an outer tube and an inner tube; and a spiral partition plate provided to bridge a gap between the outer tube and the inner tube so as to form a spiral sound passage.

In the present invention, a small air chamber may be provided in front of the speaker unit so that the small air chamber is connected to an entrance of the spiral partition plate.

The speaker system according to the present invention may further comprise a second speaker unit mounted on a baffle plate defining the empty chamber.

Additionally, a length of the spiral sound passage may be in a range of between about 0.3 m and about 4 m. Further, a cross-sectional area of the spiral sound passage may expand gradually toward an exit of the spiral sound passage.

In the speaker system according to the present invention, the sound passing through the spiral sound passage may be radiated externally via an exit opening of the spiral sound passage, and a cross-sectional area of the exit opening may be larger than an effective vibration area of the speaker unit.

Additionally, the exit opening may be formed by an exit portion comprising an acoustic tube having a cross-sectional area continuously expanding outwardly.

Alternatively, the exit opening may be formed by an exit portion comprising an acoustic tube having a cross-sectional area stepwisely expanding outwardly.

According to the present invention, a front-loaded-horn type speaker system is provided which comprises a coaxial dual-tube structure positioned in front of a speaker unit, a three-dimensional spiral sound passage formed in a gap within the coaxial dual-tube structure and an empty chamber provided on the back of the speaker unit.

The three-dimensional spiral sound passage used in the speaker system according to the present invention has a spiral horn shape formed by providing a spiral partition plate within the gap between an outer tube and an inner tube of the coaxial double-tube structure. The cross-section of the spiral sound passage is gradually enlarged toward an opening of the horn. That is, the spiral sound passage according to the present invention is defined as a three-dimensional track described by continuous rotation around a single axis and concurrent translation along the axis.

The three-dimensional spiral sound passage according to the present invention is formed by a smooth curve. Accordingly, a straight sound passage and a steeply folded portion are substantially absent, and, thus, deterioration in sound quality due to an undesired resonance or a turbulence of air current is decreased.

According to the speaker system of the present invention, since the speaker unit is located within a small space surrounded by walls, an appropriate load can be applied to a diaphragm at a low-frequency range. As a result, efficiency for converting vibration of the diaphragm into vibration of air in front of the diaphragm is increased. Additionally, a sound level at a middle-frequency range and a high-frequency range can be greatly attenuated without deterioration of sound quality such as addition of an undesired resonant sound while the vibration of air in front of the diaphragm passes through the spiral sound passage. Due to these effects, a highly pure heavy bass sound with sufficiently large acoustic energy is radiated from an opening of the horn.

Other objects, features and advantages of the present invention will become more apparent from the following detailed description when read in conjunction with the accompanying drawings.

DETAILED DESCRIPTION OF THE PREFERRED EMBODIMENTS

Figure 1:
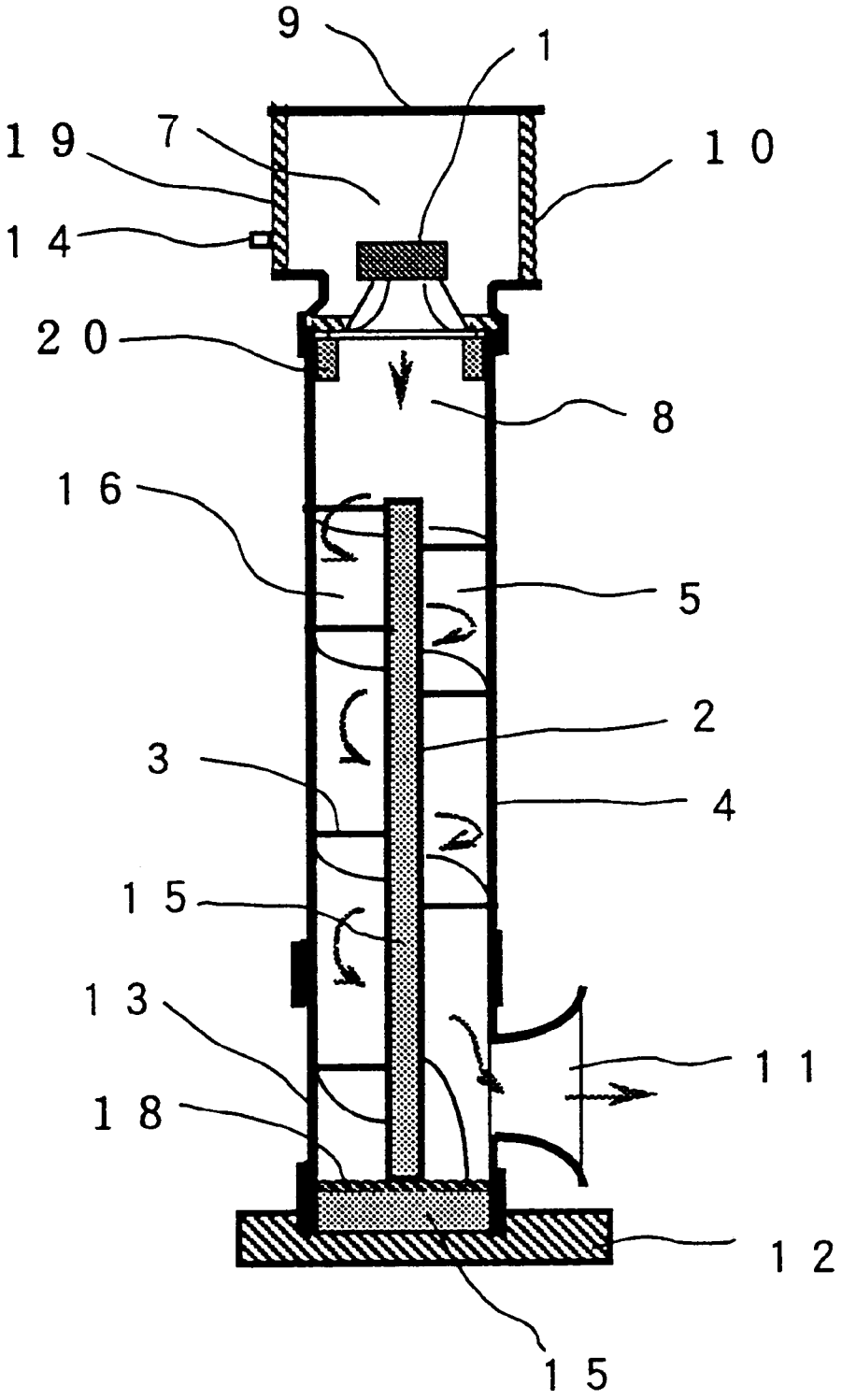
FIG. 1 is a cross-sectional view of a speaker system according to a first embodiment of the present invention.

A description will now be given, with reference to FIG. 1, of a first embodiment according to the present invention. FIG. 1 shows a speaker system according to the first embodiment of the present invention.

The speaker system shown in FIG. 1 comprises a speaker unit 1 used with a horn, an empty chamber 7 located on the back of the speaker unit 1, a small air chamber 8 provided in front of the speaker unit 1, a three-dimensional spiral sound passage 5 and an exit opening 11 of the spiral sound passage 5. A sound emitted from a front face of the speaker unit 1 is radiated outside the exit opening 11 via the small air chamber 8 and the spiral sound passage 5.

Figure 2:
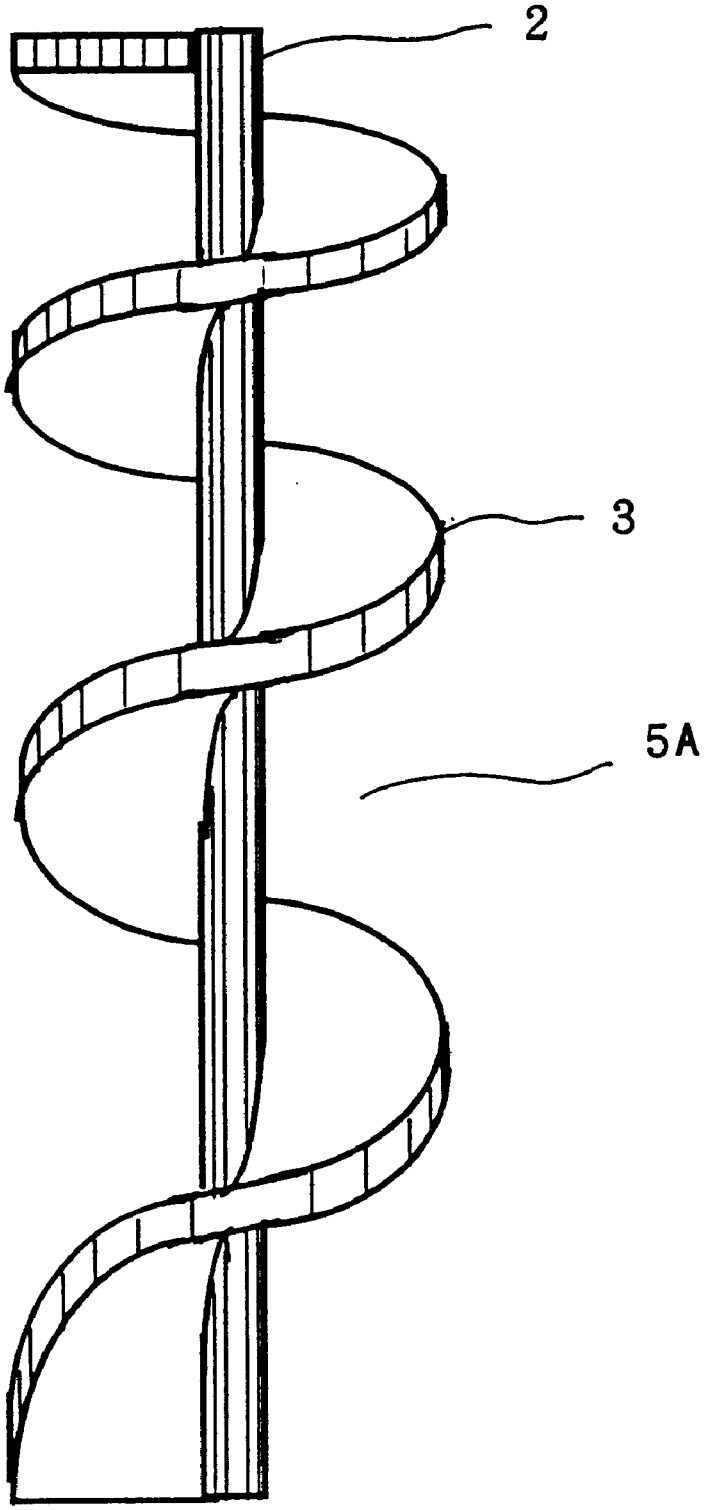
FIG. 2 is a perspective view of a spiral sound passage shown in FIG. 1.

FIG. 2 is a perspective view of the spiral sound passage 5 shown in FIG. 1. The three-dimensional spiral sound passage 5 is formed by inserting a spiral body shown in FIG. 2 into an outer tube 4 having a circular cross-section. The spiral body comprises an inner tube 2 and a spiral partition plate 3 provided around the inner tube 2 so that a spiral trough 5A is formed as shown in FIG. 2. When the spiral body is inserted into the outer tube 4, a coaxial dual-tube structure is formed by the outer tube 4 and the inner tube 2, and the partition plate 3 is located within a gap formed between the outer tube 4 and the inner tube 2. Thus, the spiral sound passage 5 shown in FIG. 1 is defined by the spiral trough 5A and an inner wall of the outer tube 4.

Figure 3:
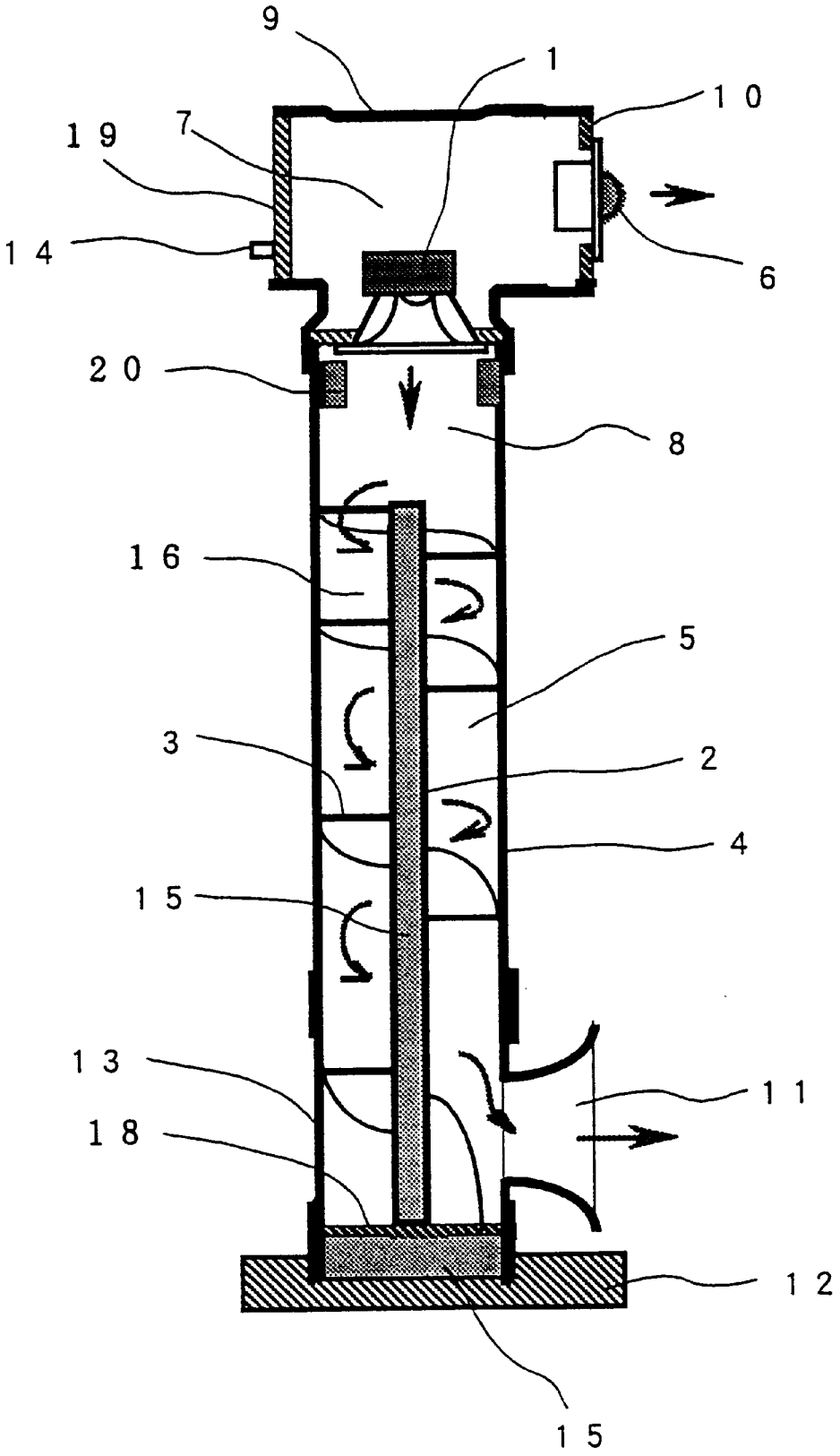
FIG. 3 is a cross-sectional view of a speaker system according to a second embodiment of the present invention.

FIG. 3 shows a speaker system according to a second embodiment of the present invention.

The speaker system shown in FIG. 3 has the same construction as the bass speaker system shown in FIG. 1 except for a second speaker unit 6 being mounted on a baffle plate 10 so that the speaker system can provide a full-range speaker function. In FIG. 3, one second speaker unit 6 is provided, however, a plurality of second speaker units may be provided for a middle-frequency range and a high-frequency range.

Generally, a sound radiated from an opening of a horn has a phase delay proportional to a length of a sound passage formed within the horn. Additionally, a middle-frequency component and a high-frequency component of a sound pressure are attenuated while the sound travels through the horn. Since there is a great difference between a length of the sound passage in the spiral sound passage 5 measured along an innermost periphery and that measured along an outermost periphery, it is considered that a distribution of the phase delay is generated in the sound during a period after the sound is generated by a front face of the diaphragm until the sound is radiated from the exit opening 11.

In a regular horn system, a phenomenon must be measured in which phenomenon a sharp dip is generated in a sound pressure versus frequency characteristic at a specific frequency due to interference of a sound radiated from an exit opening of the horn with a sound forwarded from a front face of the second speaker unit. However, in the present invention, such a phenomenon is relaxed by effects of the above-mentioned phase delay distribution and attenuation of the middle- and high-frequency components, which attenuation provides a sound pressure versus frequency characteristic having little dip.

In order to further assure the prevention of generation of the dip in the sound-pressure versus frequency characteristic, the small air chamber 8 is provided in front of the speaker unit 1 so as to absorb middle- and high-frequency components by an acoustic capacitance of the small air chamber 8. Additionally, the middle- and high-frequency components may be absorbed by providing a sound-absorbing material in the empty chamber 7 and the small air chamber 8.

The length of the spiral sound passage 5 is defined as an axial length along the center of the diameter of the spiral sound passage 5. The diameter is defined as a mean diameter calculated from the inner diameter and the outer diameter. Preferably, the length of the spiral sound passage 5 is between 0.3 m and 4 m. If the passage is shorter than 0.3 m, attenuation at a middle-frequency range and a high-frequency range is insufficient. If the passage length exceeds 4 m, there is deterioration in sound quality due to an appreciable time delay of a sound exiting from the exit opening 11 to reach a listener's position. In addition, there is a problem in that the acoustic output drops since resistance in the sound passage increases. There is no limitation in a number of spiral turns, but more than 0.5 turns is preferable for sufficiently attenuating the middle- and high-frequency components.

The cross-sectional area of the spiral sound passage 5 is defined as an area of a section through a plane that includes an axis of the coaxial dual-tube structure. Given that the effective vibration area of the speaker unit 1, a throat 16 (refer to FIG. 4) of the spiral sound passage 5 may preferably have a cross-sectional area of between 0.1 to 1.5. The cross-sectional area of the spiral sound passage 5 may remain unchanged in the direction of travel of the sound. Normally, it is more preferable that the sound passage be flared or continuously expanded in cross-sectional area.

Continuous expansion of the spiral sound passage may not necessarily be exponential as long as it is gradual and smooth. The spiral sound passage 5 may expand in its height, width or both. FIGS. 1, 2 and 3 show a case where the height of the passage expands while its width remain unchanged. Other approaches to expand the sound passage by expanding its width may include enlarging the diameter of the outer tube toward the bottom of the speaker system or reducing the diameter of the inner tube toward the bottom.

The inner tube 2 may be a solid rod instead of a hollow tube. If the inner tube 2 is hollow, adverse effects on sound quality due to vibration of air in the inner tube 2 can be reduced by filling the inner tube 2 with sand, lead particles or various kinds of sound-absorbing materials.

Since the spiral sound passage 5 according to the present invention is surrounded by smoothly curved surfaces, resonance is relatively unlikely, and, thus, it is less likely that spurious sound is produced.

It is desirable that the cross section of each of the inner tube 2 and the outer tube 4 is circular. Tubes with a circular cross-section are easier to produce than tubes of other configurations. Additionally, tubes with a circular cross-section enable forming a sound passage with substantially no straight portions in the direction of travel of the sound. Therefore, resonance is unlikely to occur and air turbulence is diminished. The contour of the cross section of the outer tube 4 is not necessarily a circle, and a square cross-section or the like may be adopted. The inner tube 2 and the outer tube 4 are arranged coaxially so as to produce a coaxial dual-tube structure.

Figure 5:
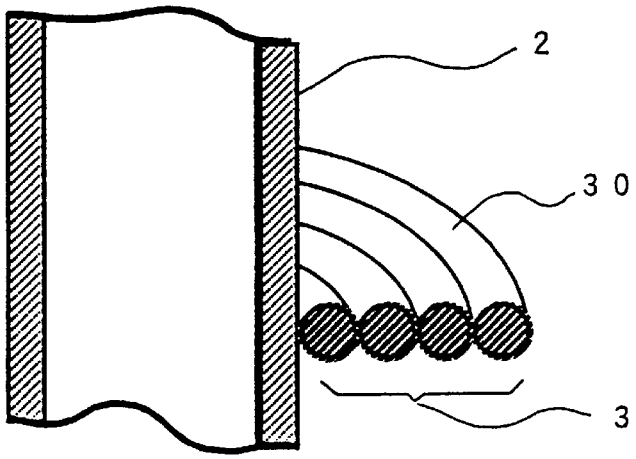
FIG. 5 is an illustration for explaining a method for forming a spiral partition plate shown in FIGS. 1 and 3.

The spiral partition plate 3 may be formed of a variety of materials and according to a variety of methods. For example, the spiral partition plate 3 may be formed such that a cable or tubing formed of a rubber or plastic plate or an elongated compound material such as a cabtire cable 30 is wrapped one upon another around the inner tube 2, as shown in FIG. 5, and glued to the inner tube 2 by an adhesive. When the spiral partition plate 3 is formed of a flexible material, it is desirable that the rigidity of the spiral partition plate 3 be improved by applying an epoxy resin or the like to the spiral partition plate 3 in order to prevent vibration. The resultant spiral body is inserted into the outer tube 4. By joining the periphery of the spiral partition plate 3 with the interior of the outer tube 4, the spiral sound passage 5 is formed.

Various other methods are available to mass-produce the spiral sound passage 5. Plastic injection molding would be especially preferable. Each block manufactured by plastic injection molding would correspond to one spiral turn of the spiral body or of the combination of the outer tube 4 and the spiral body. Alternatively, each block manufactured by plastic injection molding may not form a complete spiral turn. The spiral sound passage or the spiral body is formed by joining a plurality of blocks thus produced. Such a production method does not require high-level craftsmanship and can be used to produce the speaker system of the present invention because its structure is suitable for mass production.

In order to improve a reproducing capability for a heavy bass sound by applying a load to a diaphragm, the empty chamber 7 is preferably an enclosure type. terminals 14 are provided to a plate 19 defining the empty chamber 7. The empty chamber 7 may include a port which can constitute a reflex baffle type system, or may be connected to another spiral sound passage. The speaker unit 1 and the empty chamber 7 may be fitted to the coaxial dual-tube structure using a tubular member such as a T joint or an L joint. It is preferable that the empty chamber 7 is filled with a sound-absorbing material.

Figure 4:
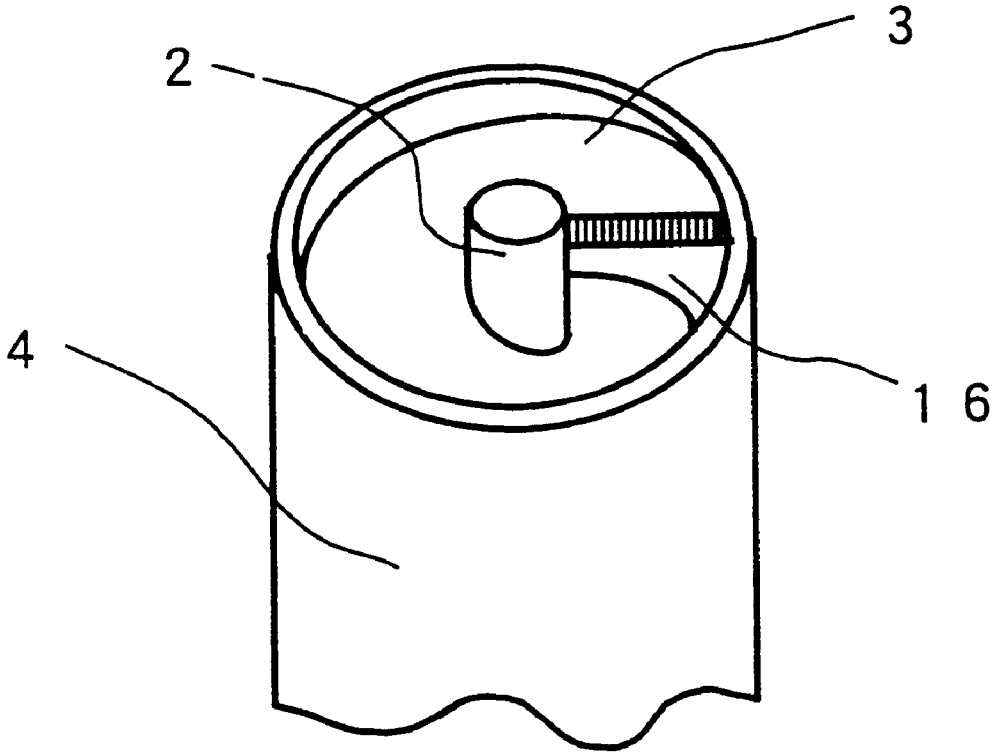
FIG. 4 is a perspective view of an upper part of the spiral sound passage shown in FIGS. 1 and 3.

In the above-mentioned embodiments, the small air chamber 8 is provided in front of the speaker unit 1. However, the small air chamber 8 may be eliminated if it is not necessary. A sound forwarded from the speaker unit 1 reaches an entrance of the spiral sound passage 5, that is, the throat 16 via the small air chamber 8. Meddle-and high-frequency components of the sound attenuate while the sound travels through the spiral sound passage 5. Accordingly, a low-frequency component and remaining middle- and high-frequency components exit from the exit opening 11. A propagation path of a sound traveling through the spiral sound passage 5 is indicated by arrows in FIGS. 1 and 3. The small air chamber 8 is provided with a sound-absorbing material 20 as shown in FIGS. 1 and 3 so as to increase an acoustic output level of a bass sound. Additionally, an inner wall of the spiral sound passage 5 may be covered with a sound-absorbing material having a thickness of 0.1 mm to 20 mm, if necessary, so as to promote attenuation of the middle- and high-frequency components. As for the sound-absorbing material, a regular sound-absorbing material such as glass-wool, felt or urethane foam may be used. Alternatively, woven fabric, nonwoven fabric or paper may be used. A configuration of the throat 16 is shown in FIG. 4. It should be noted that rotation of the spiral may be either in the leftward direction or the rightward direction.

In the cabinet shown in FIGS. 1 and 3, the sound traveling through the spiral sound passage 5 is radiated outside from the exit opening 11. The cross-sectional area of the exit opening 11 is preferably larger than the effective vibration area of the speaker unit 1 or the cross-sectional area of the entrance to the spiral sound passage 5. More preferably, an acoustic tube having an exit opening of which a cross-sectional area is enlarged smoothly or stepwisely is used. According to such an arrangement, air-flow resistance is reduced and the bass boost provided by the horn is improved.

In FIG. 3, the second speaker unit 6 is positioned so that a sound forwarded from the second speaker unit 6 is forwarded in the same direction as a sound exiting from the exit opening 11 of the spiral sound passage 5. However, the second speaker unit 6 can be positioned in an arbitrary angular position with respect to the exit opening 11 of the spiral sound passage 5.

Preferably, the speaker unit 1 used in the present invention is embodied by one full-range speaker unit or one woofer unit. Alternatively, a plurality of speaker units may be used. A network may also be used. Preferably, the speaker unit 1 includes a strong magnet and a light-weight diaphragm.

Figure 6:
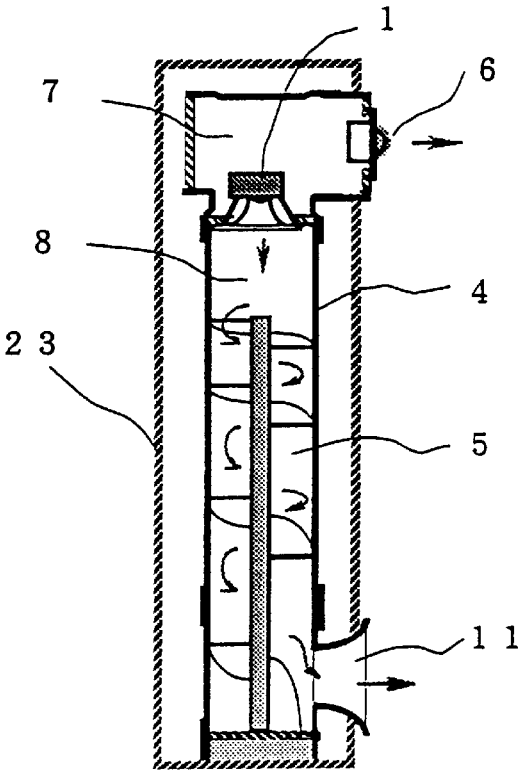
FIG. 6 is a cross-sectional view of the speaker system shown in FIG. 3 accommodated in a box.

In the speaker system shown in FIGS. 1 and 3, a space is effectively used by the three-dimensional spiral sound passage 5 being located in front of the speaker unit 1, which enables reduction in size of the FLH. The outward appearances of the speaker systems shown in FIGS. 1 and 3 are different from that of a conventional box-type speaker system. This may provide a sense of incongruity to a listener. However, such a sense of incongruity can be eliminated by accommodating the speaker system within an outer box 23 as shown in FIG. 6. In the speaker system shown in FIG. 6, only the second speaker unit 6 and the exit opening 11 of the spiral sound passage 5 are open to atmosphere.

A detailed description will now be given of the speaker systems according to the present invention.

FIG. 1 shows a basic structure of the speaker system (first embodiment) according to the present invention.

The outer tube 4 is formed by cutting a hard polyvinyl chloride JIS-compliant pipe (VP125) having an inner diameter of 125 mm to a length of 400 mm. The inner tube 2 is formed by cutting a hard polyvinyl chloride JIS-compliant pipe (VP20) having an inner diameter of 20 mm to a length of 400 mm.

A length of the spiral body shown in FIG. 2 is 400 mm which is equal to the length of the inner tube 2. The spiral partition plate 3 is formed by wrapping five cabtire cables 30 of a diameter of 10 mm one upon another around the periphery of the inner tube 2 and by securing the cabtire cables to each other and to the inner tube 2 by a cyanoacrylate adhesive so that an outer diameter of the spiral partition plate 3 is 125 mm. Further, an epoxy resin is applied to the entirety of the spiral partition plate embodied by the cabtire cables so that the spiral partition plate 3 is made rigid enough to prevent undesired vibration from occurring. An epoxy resin is applied to the periphery of the spiral body thus produced before being inserted into the outer tube 4 and a T joint 13. The spiral sound passage 5 is formed by fixing the spiral body to the outer tube 4 and the T joint 13 by adhesive. The lower end of the spiral partition plate 3 is attached by adhesive to a bottom plate 18 to which the lower end of the inner tube 2 is also attached by adhesive. The peripheral position of the bottom end of the spiral partition plate 3 is determined by controlling the orientation of the spiral body so that the sound passing through the spiral sound passage 5 is smoothly guided to the exit opening 11. The inner tube 2 is filled with a felt material 15 so as to reduce undesired vibration. The lower end of the T joint 13 is fixed to a base plate 12. The felt material 15 is also provided in a space between the bottom plate 18 and the base plate 12.

The small air chamber 8 provided between the speaker unit 1 and the spiral sound passage 5 has a volume of 1.8 liters. The sound-absorbing material (felt) 20 having a width of 40 mm and a thickness of 8 mm is glued to a wall under the front face of the speaker unit 1 so that the sound pressure level of a bass range is increased. The number of spiral turns of the spiral sound passage 5 is two, and its length is about 0.9 m. A cross-sectional area of the entrance (throat 16) of the spiral sound passage 5 is 45 $cm^2$ and is smoothly expanded so that a cross-sectional area of the exit becomes 78 $cm^2$. The expansion of the spiral sound passage 5 is achieved so that a width of the spiral sound passage 5 is constant and a height is continuously increased. It should be noted that a number R of spiral turns of the spiral sound passage 5 and a number P of rotations of the spiral partition plate 3 satisfy the following relationship.

$P=R+1$

It should be noted that each of a T joint 9 and the T joints 13 is made of a hard polyvinyl chloride JIS-compliant component which matches the above-mentioned pipe VP125. Additionally, the cross-sectional area of the entrance to the acoustic tube constituting the exit opening 11 of the spiral sound passage 5 is 122 $cm^2$, and is exponentially expanded so that the cross-sectional area of the exit becomes 350 $cm^2$.

A 10-cm full-range speaker unit (FOSTEX FE108Σ) is fitted to the end of the vertical tubular section of the T joint 9 so that a front face of the speaker unit faces downwardly. This speaker unit is provided with a powerful magnetic circuit using a large ferrite magnet and a lightweight cone having an equivalent mass of 2.7 grams. The impedance is 8 Ωand the effective vibration area is 50 $cm^2$. The interior of the T joint 9 constitutes the empty chamber 7 behind the speaker unit 1 embodied by this product. The effective volume of the empty chamber 7 is approximately 4 liters. The empty chamber 7 is filled with a sound-absorbing material (not shown). The height of the thus-produced speaker system is 850 mm.

Figure 7:
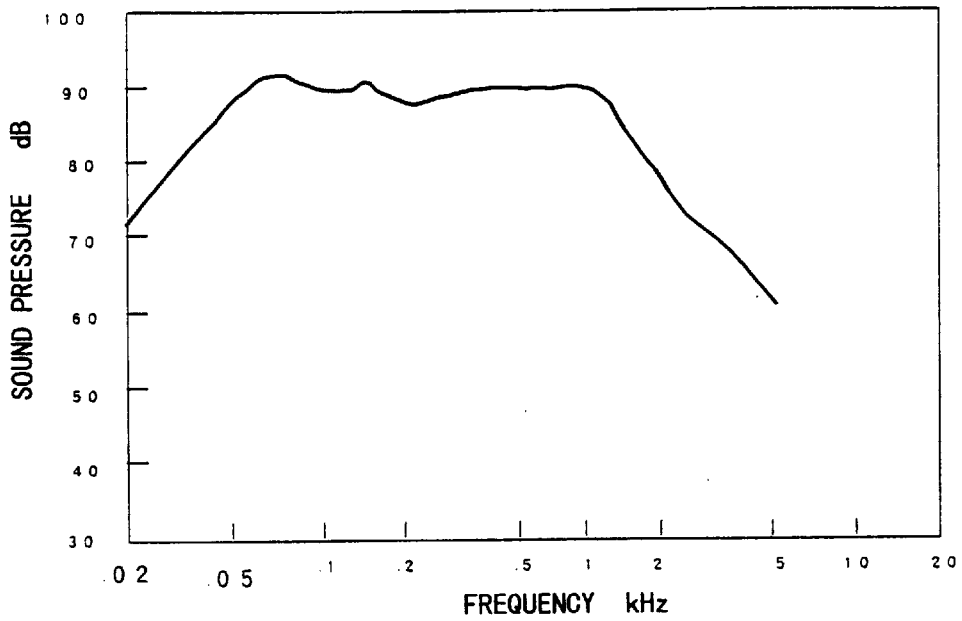
FIG. 7 is a graph showing a sound pressure versus frequency characteristic of the speaker system according to the first embodiment shown in FIG. 1.

The speaker system according to the first embodiment of the present invention is capable of reproducing a sound ranging from a heavy bass sound of 25 Hz to a middle range sound of 1.5 kHz. FIG. 7 is a graph showing a sound pressure versus frequency characteristic of the speaker system according to the first embodiment shown in FIG. 1. It can be appreciated from the graph of FIG. 7 that the sound pressure level at a heavy bass range is high while the sound pressure level at middle- and high-frequency ranges is remarkably attenuated.

FIG. 3 shows the speaker system according to the second embodiment of the present invention that includes the second speaker unit 6 for reproducing middle- and high-frequency ranges.

The second speaker unit 6 is mounted to the baffle plate 10 defining the empty chamber 7. A middle to high range speaker unit (FOSTEX FT38D) is used for the second speaker unit 6, and is connected in parallel and reversed phase to the speaker unit 1 via a capacitor having a capacitance of 6.8 $\mu$F.

Figure 8:
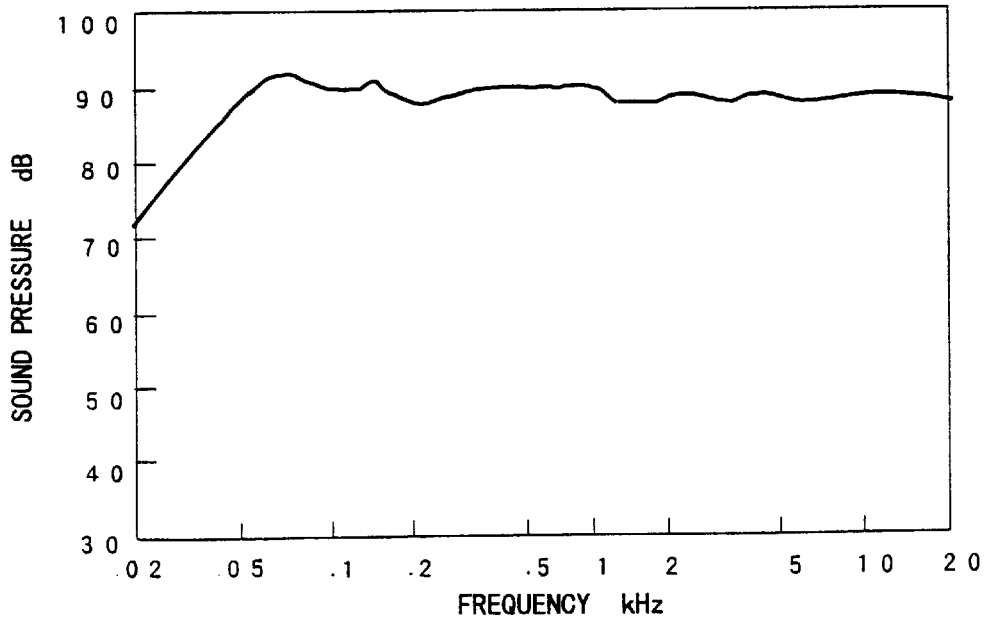
FIG. 8 is a graph showing a sound pressure versus frequency characteristic of the speaker system according to the second embodiment shown in FIG. 3.

FIG. 8 is a graph showing a sound pressure versus frequency characteristic of the speaker system according to the second embodiment shown in FIG. 3. It can be appreciated from the graph that the speaker system according to the second embodiment is capable of reproducing a sound over a wide range since a sound radiated by the second speaker unit 6 is added to a bass sound radiated from the exit opening 11. High resolution of the low-frequency component and the transition characteristic are particularly appreciated. Additionally, sound quality is excellent due to the absence of spurious sound such as reverberations and repercussions normally experienced with a conventional FLH. Further, a massive bass sound reproduced by the speaker system according to the present invention is superior to that of the improved BLH speaker system previously suggested by the present inventor.

As mentioned above, the speaker systems according to the present invention have the following advantages.

(1) With introduction of a three-dimensional spiral sound passage, a sound passage of a sufficient length is provided in a relatively small space so that richness in sound quality is available even in a compact system.

(2) Since a straight sound passage is substantially absent, undesired resonance harmful to sound quality is controlled to a low level so that excellent sound quality can be obtained.

(3) The system is more suitable for mass production than a conventional FLH so that reduction in production cost is facilitated.

(4) Since the spiral sound passage boosts bass, a single small-diameter full-range speaker unit is capable of satisfactory bass reproduction performance.

(5) A good transition characteristic at a low-frequency range, which is an advantage of the FLH, is successfully provided.

The present invention is not limited to the specifically disclosed embodiments, and variations and modifications may be made without departing from the scope of the present invention.

The present application is based on Japanese priority application No. 10-71177 filed on Feb. 13, 1998, the entire contents of which are hereby incorporated by reference.

What is claimed is:

1. A speaker system comprising:

a speaker unit;

an empty chamber provided in a back of said speaker unit;

a coaxial dual-tube structure provided in front of said speaker unit, said coaxial dual-tube structure comprising an outer tube and an inner tube; and a spiral partition plate provided to bridge a gap between said outer tube and said inner tube so as to form a spiral sound passage.

2. The speaker system as claimed in claim 1, wherein a small air chamber is provided in front of said speaker unit so that said small air chamber is connected to an entrance of said spiral partition plate.

3. The speaker system as claimed in claim 1, further comprising a second speaker unit mounted on a baffle plate defining said empty chamber.

4. The speaker system as claimed in claim 1, wherein a length of said spiral sound passage is in a range of between about 0.3 m and about 4 m.

5. The speaker system as claimed in claim 1, wherein a cross-sectional area of said spiral sound passage expands gradually toward an exit of said spiral sound passage.

6. The speaker system as claimed in claim 1, wherein the sound passing through said spiral sound passage is radiated externally via an exit opening of said spiral sound passage, and a cross-sectional area of said exit opening is larger than an effective vibration area of said speaker unit.

7. The speaker system as claimed in claim 6, wherein said exit opening is formed by an exit portion comprising an acoustic tube having a cross-sectional area continuously expanding outwardly.

8. The speaker system as claimed in claim 6, wherein said exit opening is formed by an exit portion comprising an acoustic tube having a cross-sectional area stepwisely expanding outwardly.

* * * * *